United States Patent [19]

Buttermann

[11] Patent Number: 5,040,742

[45] Date of Patent: Aug. 20, 1991

[54] EQUIPMENT FOR THE START-UP CONTROL OF BOBBIN CREELS

[75] Inventor: Günther Buttermann, Nettetal, Fed. Rep. of Germany

[73] Assignee: Hacoba Textilmachinen GmbH & Co., Wuppertal, Fed. Rep. of Germany

[21] Appl. No.: 255,999

[22] Filed: Oct. 11, 1988

[30] Foreign Application Priority Data

Oct. 13, 1987 [DE] Fed. Rep. of Germany ..... 3734518

[51] Int. Cl.[5] ..... B65H 54/00; D02H 13/04

[52] U.S. Cl. ..... 242/131.1

[58] Field of Search ..... 242/37 R, 45, 131.1, 242/131, 149, 150 R; 200/61.18

[56] References Cited

U.S. PATENT DOCUMENTS

| | | | |
|---|---|---|---|
| 1,605,373 | 11/1926 | Peterson | 242/131.1 |
| 2,325,974 | 8/1943 | Pasquerello | 242/150 X |
| 2,723,088 | 9/1952 | Hansen | 242/150 |
| 3,873,043 | 3/1975 | Wildi et al. | 242/131.1 |
| 4,157,722 | 6/1979 | Tojo et al. | 242/150 R X |
| 4,598,184 | 7/1986 | Price et al. | 242/131.1 X |
| 4,646,989 | 3/1987 | Van Wilson | 242/131.1 |
| 4,664,335 | 5/1987 | Kohlen | 242/131.1 |
| 4,694,765 | 9/1987 | Diehl | 242/150 R X |

FOREIGN PATENT DOCUMENTS 3436714 4/1986 Fed. Rep. of Germany .

*Primary Examiner*—Daniel P. Stodola
*Assistant Examiner*—John P. Darling
*Attorney, Agent, or Firm*—O'Keefe & Wilkinson

[57] ABSTRACT

A device for the start-up control of bobbin creels for warp beams or warping reels, the winding heads of which, disposed in rows and columns, each have associated with them a yarn monitor, which causes the yarn to be deflected by a stop-motion sensor, and a yarn gripper, by means of which a yarn can be clamped between a thrust block and a clamping jaw, which interacts with the thrust block and has limited motion, and which is acted upon by a control element, especially a control spring, the clamping force of which in the clamping region between the clamping position and the open position can be controlled while the machine is starting up by an adjusting device, which acts jointly on all the yarn grippers open position.

In order to bring about an optimum control of the yarn gripper, the device is designed so that the clamping jaw at the clamping force control is designed so as to be relatively free of movement in the direction of the longitudinal extent of the thrust block, and its clamping force is directed exclusively perpendicular to the thrust block surface.

3 Claims, 7 Drawing Sheets

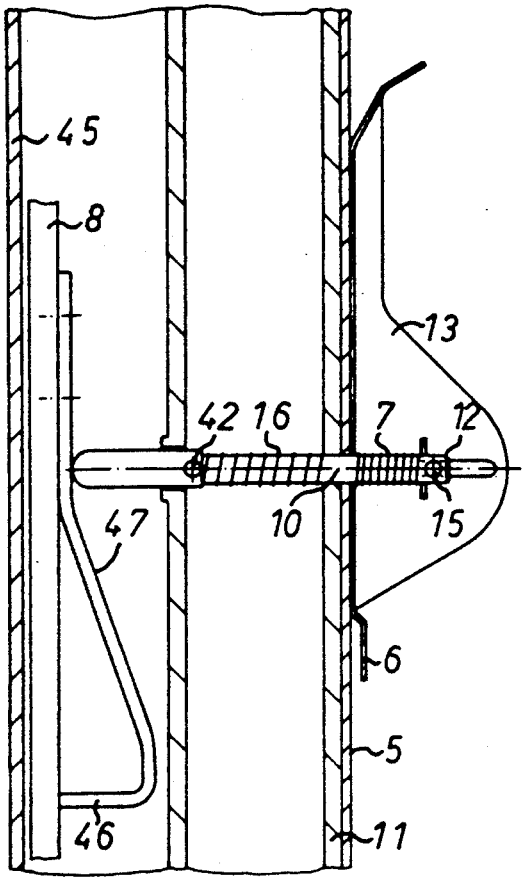
FIG.7a
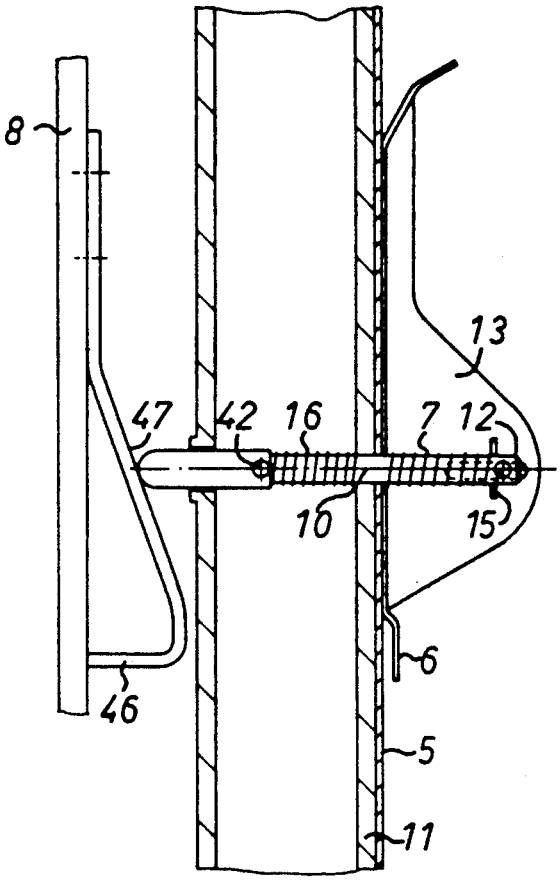
FIG.7b
FIG.7c
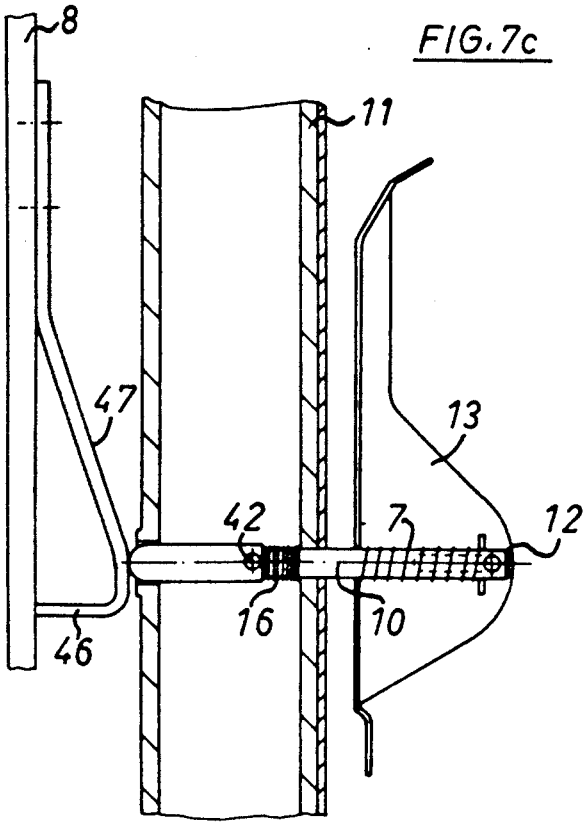

EQUIPMENT FOR THE START-UP CONTROL OF BOBBIN CREELS

BACKGROUND OF THE INVENTION

1. Field of the Invention

This invention relates to a device for the start-up control of bobbin creels for beam warpers or warping reels, the winding heads of which, disposed in rows and columns, each have associated with them a yarn monitor, which causes the yarn to be deflected by a stop-motion sensor, and a yarn gripper. More particularly in the present invention a yarn is clamped by the yarn gripper between a thrust block and a clamping jaw, which interacts with the thrust block and has limited motion. The clamping jaw is acted upon by a control element, especially a control spring, the clamping force of which in the clamping region between the clamping position and the open position can be controlled while the machine is starting up by an adjusting device, which acts jointly on all the yarn grippers.

2. Description of the Related Art

Such a device is known from the German Auslegesschrift 3,436,714. The known yarn gripper has a horizontal clamping jaw, which presses a horizontally directed yarn against the underside of a plate-shaped horizontal thrust block. This is done by a positioning rod, which likewise acts horizontally and which acts on one end of a leaf spring. When the yarn is clamped or braked, the other end of the leaf spring is clamped movably in the adjusting direction. The clamping jaw of the yarn gripper is fastened approximately at the center of this leaf spring. Due to this design, the clamping jaw executes a motion relative to this thrust block when the yarn is being acted upon. This relative motion is in the direction in which the adjusting rod is activated and thus in the longitudinal direction of the thrust block. The clamping force is also aligned at an angle to the thrust block, which results in complications while the machine is starting up. Especially with thin, twisted threads, and with and an appropriate throw of the shuttle the yarn may tend to untwist. This is associated with a corresponding displacement or movement of the yarn at the yarn braking point and prevents the desired correct influence on the braking of the yarn.

OBJECT OF THE INVENTION

It is therefore an object of the invention to provide a bobbin creel of the type mentioned in the introduction, which is improved with respect to its yarn grippers, so that the yarn can be braked perfectly without any problem with all possible yarn designs.

This objective is accomplished as follows: The clamping jaw at the clamping force control unit is designed so as to be relatively free of movement in the direction of the longitudinal extent of the thrust block, and its clamping force is directed exclusively perpendicular to the thrust block surface.

BRIEF SUMMARY OF THE INVENTION

The present invention obviates the deficiencies of prior start-up control arrangements for bobbin creels and the like by providing a yarn gripping arrangement including a thrust block and a clamping jaw in which the clamping jaw is moved exclusively perpendicularly to the thrust block surface by means of an activating element having a movement exclusively perpendicular to the thrust block surface. Preferably, the activating element takes the form of a perpendicularly movable bolt or rod engageable with the clamping jaw and having a degree of longitudinal play with respect to the clamping jaw. The clamping jaw is preferably biased toward the thrust block surface by resilient means which may be a control spring means closely engaged with the perpendicularly movable bolt. The engaging surfaces of the thrust block and clamping jaw are preferably substantially vertically oriented and yarn passing between such engaging surface is guided by means external to the two surfaces between the central portion of such surfaces and over a control arm associated with a stop motion sensor device.

Figure 1:
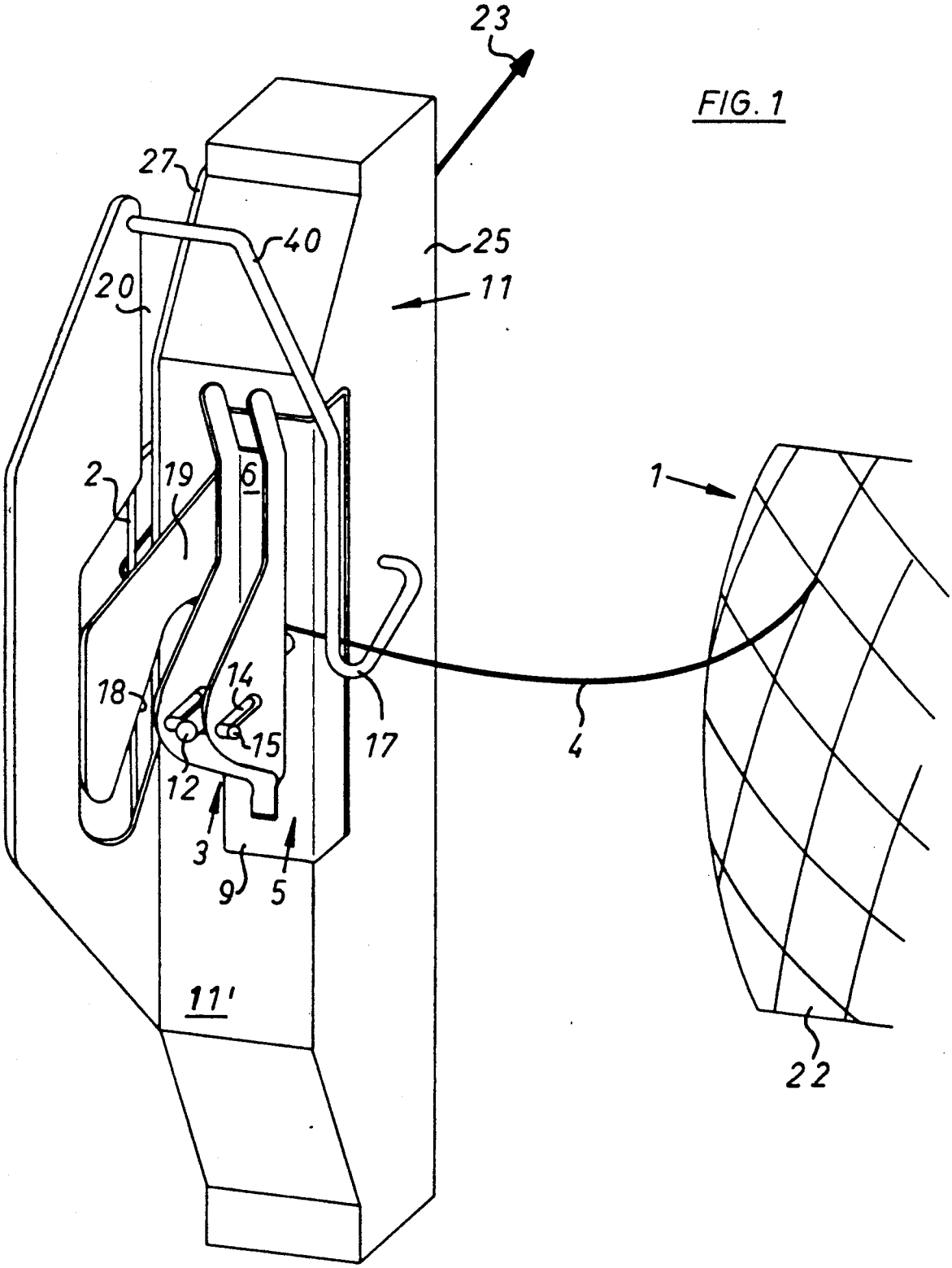
FIG. 1 shows an overall perspective view of a device for the start-up control of bobbin creels.

FIG. *7a* through *7c* show longitudinal sections through a device built into a vertical frame rail of the bobbin creel, in a simplified representation, to elucidate the mode of operation of the yarn gripper.

DESCRIPTION OF THE PREFERRED EMBODIMENTS

It is an important feature of the invention that the motion of the clamping jaw is influenced while the clamping force is being controlled. This influence no longer permits relative motion in the direction of the longitudinal extent of the thrust block. Rather, the clamping force is applied exclusively perpendicular to the thrust block surface, so that the course of the yarn or the clamping point within the yarn gripper cannot be changed by activating variables from the yarn gripper itself.

There are a plurality of structural possibilities in accordance with the present invention for achieving the above-mentioned perpendicular guidance of the clamping jaw. However, it is advantageous if the clamping jaw, which is being acted upon by the control spring, is retained by a movable bolt that is disposed perpendicular to the thrust block surface and to the yarn. In this case, the desired direction of motion of the clamping jaw, which is being acted upon by the control spring, can be imparted exactly to the bolt, and additional guiding measures are obviated. In this sense, the bolt is mounted axially movable in a clamp housing, which contains the thrust block surface. It passes or extends to the movable clamping jaw free of radial backlash or play. The end of the bolt at the backside of the jaw grips the clamping jaw with movable axial backlash or play. In this way, it is possible to achieve, on the one hand, the desired control of the clamping force and, on the other hand, a defined clamping behavior. The axial backlash or play between the clamping jaw and the end of the bolt is achieved owing to the fact that the clamping jaw has activation tabs, which protrude on the backside and which have slots parallel to the bolt, which are engaged by a cross-pin of the bolt.

To match the design of the control spring optimally to the bolts, which influence or control it and the yarn gripper, the control spring, which acts on the clamping jaw, surrounds the bolt, while its other end is supported on the cross-pin of the bolt.

It is furthermore of importance that the clamping jaw is disposed outside of its yarn gripping position against the control spring, which acts upon it, so as to have limited mobility with respect to the bolt. Consequently, especially with a control spring that has a flat characteristic, it is possible to grip yarns of different thickness by means of the yarn gripper, without affecting the gripping and control characteristic of the yarn gripper. Structural tolerances of the yarn gripper can thus also be controlled perfectly.

The bolt is acted upon by a clamp spring that is supported in the clamp housing. When the clamping jaw is in its clamping position, this clamp spring holds the bolt in a contact position at the housing while overcoming the force of the control spring. In this way, the bolt pin has a defined stationary position in the housing. As a result, the force of the control spring in the clamping position of the yarn gripper has a single defined value.

In a further development of the invention, the yarn gripper has a yarn guiding element, which holds the yarn above the bolt. This largely avoids wear of the yarn at the bolt and also at the gripper parts, so that the smooth running of the bolt and therewith the control of the yarn gripper cannot unintentionally be affected by yarn wear or sluggishness of the bolt.

Furthermore, a protrusion which upwardly limits the vertical yarn excursion is present at the thrust block, which forms the thrust block surface. This protrusion furthermore also has an essentially vertical yarn guiding edge, which limits the yarn excursions directed perpendicularly thereto. Due to the protruding design of the yarn gripper, the yarn is subjected to constrained guidance in its gripping range. The yarn is not able to make such changes in its position in the region of the yarn gripper, that elements of the yarn gripper, which effect the control, can be affected by the dynamics inherent in the yarn. The height of the yarn gripping point relative to the clamping jaw is practically fixed, so that, for example, its tolerance-based tilting backlash about a horizontal axis does not affect the gripping or the control of the yarn gripper. Furthermore, the above-described guidance of the yarn in the gripping region of the yarn gripper or the fixing of the yarn running point in the yarn gripper prevents the stop motion sensor from being exposed to unwanted dynamic influences originating from the course of the yarn. In particular, the stop motion sensor need not be used to limit the vertical yarn excursions.

With an essentially vertical insert slot, which is formed by parts of the clamping housing for inserting the yarn in the yarn gripper, it is therefore possible that for the upper end of the stop motion sensor is disposed so as not to cover the slit at all possible needle positions. This applies to bobbin creels for beam warpers or warping reels, winding heads of which are disposed by rows and lines. Each winding head is associated with a yarn monitor which deflects the yarn by means of a stop motion sensor, as well as with a yarn gripper. The yarn can thus be inserted without difficulty, and the design of the yarn gripper does not have to provide for bringing the yarn into a particular position relative to the end of the stop motion sensor. There is furthermore no danger that the inserted yarn will leave the height range of the stop motion sensor and thus make monitoring impossible.

In this sense, the end of the needle is advantageously disposed above a protrusion, which upwardly limits the vertical excursion of the yarn, next to the insert slot at the housing. The protrusion, which reliably limits the upwards excursion of the yarn, ensures that the yarn does not leave a height range, which makes monitoring possible.

The invention is additionally explained and exemplified by means of an embodiment that is shown and described in the accompanying drawings.

Figure 4:
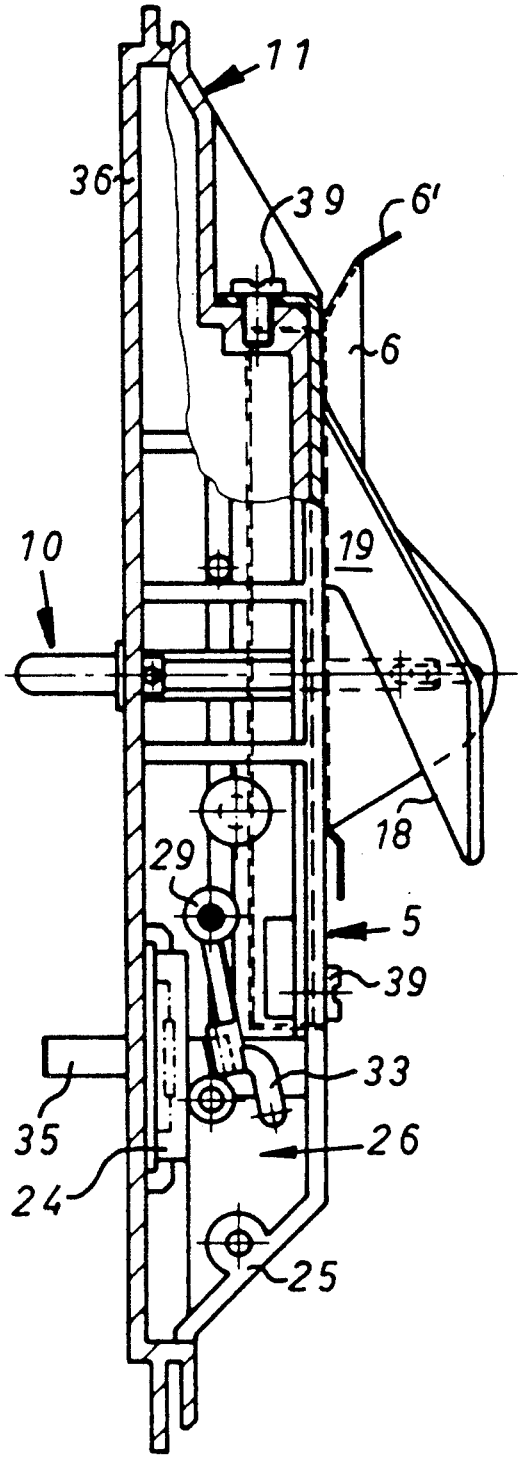
FIG. 4 shows a view corresponding to FIG. 3 with the housing cover removed.

FIG. 1 shows a device for start-up control of bobbin creels. This is one of many devices to influence the course of a yarn 4 from a winding head 1 equipped with a spool 22, in the direction of the arrow 23, to a (not shown) winding machine. This winding machine winds up all the yarns of the bobbin creel. The yarns always traverse a device with deflection at a stop-motion sensor 2. An essential component of this device, which is especially used for so-called V-creels, the yarn running speeds of which are comparatively high, is a yarn gripper 3 and a yarn monitor with a stop-motion sensor 2. The traversing yarn 4 is partially looped around the stop-motion feeler 2. The tension in the yarn keeps the stop-motion sensor 2 in a position, in which signal generator 24 of the yarn monitor, interacting with the stop-motion sensor 2 does not produce a signal. The signal generator 24 is sketched in FIG. 4. However, if the yarn breaks and the yarn tension consequently slackens, the stop-motion sensor 2 causes a signal to be emitted and thus causes the winding machine to stop. Furthermore, the other yarns 4 are kept under tension, so that warp is not impaired by slack yarns, which have become entangled. Moreover, care must be taken to ensure that the restart occurs in a controlled fashion, so that the warp sheet is monitored from the very start. These operating requirements lead to conditions, which the device described must also fulfill. They are described extensively in FIG. 8 of the German Offenlegungsschrift 3,436,714. Reference is made to this and to the associated description.

The device shown in the Figures has a clamp housing 11, which accomodates and stores the yarn gripper 3 and the yarn monitor. The yarn gripper 3 essentially comprises a thrust block 5 and a clamping jaw 6, which can move relative to the thrust block 5. These components are affixed at a housing body 25, which is closed all around. On the needle side, it has an installation opening 26 for installing parts of the yarn gripper 3 and of the yarn monitor. This opening is sealed by a cover plate 27, which is fastened to the housing body 25 by means of fastening screws 28. The cover plate 27 has a sheet metal hook 37, which protrudes according to FIG. 3 and forms at least parts of an insert slit 20. The sheet metal hook 37 has a rhomboidal recess 38. Furthermore, according to FIG. 1, the free end of this hook 37 is connected, via a wire hoop 40, to the clamp housing 11 or to the side of this housing, which lies opposite the cover plate 27. The hoop 40 forms a yarn guiding element 17, which does not allow the yarn 4 to sink lower.

The cover plate 27 supports the stop-motion feeler 2 with a trunnion 29, which is inserted into a sleeve piece 31 disposed at the other side of the cover plate 27. One of the free ends of sleeve piece 31 engages an integrally attached connection piece 32 of the housing body 25. A contact finger 33 is attached at the sleeve piece 31. It ensures that the signal generator 24 will deliver a signal, when the contact finger moves from its position shown in FIGS. 3 and 4 to make contact with the signal generator 24, which is equipped with two contact lugs 35. This happens when the stop-motion sensor rod or feeler rod 2 tilts clockwise from the position shown in FIG. 3. This it will do as a result of gravity, because its center of gravity is situated to the right of the axle pin 29. In its tilted position, the stop-motion sensor 2 does not extend into the insert slot 20 for the yarn 4, which is explained below.

Figure 3:
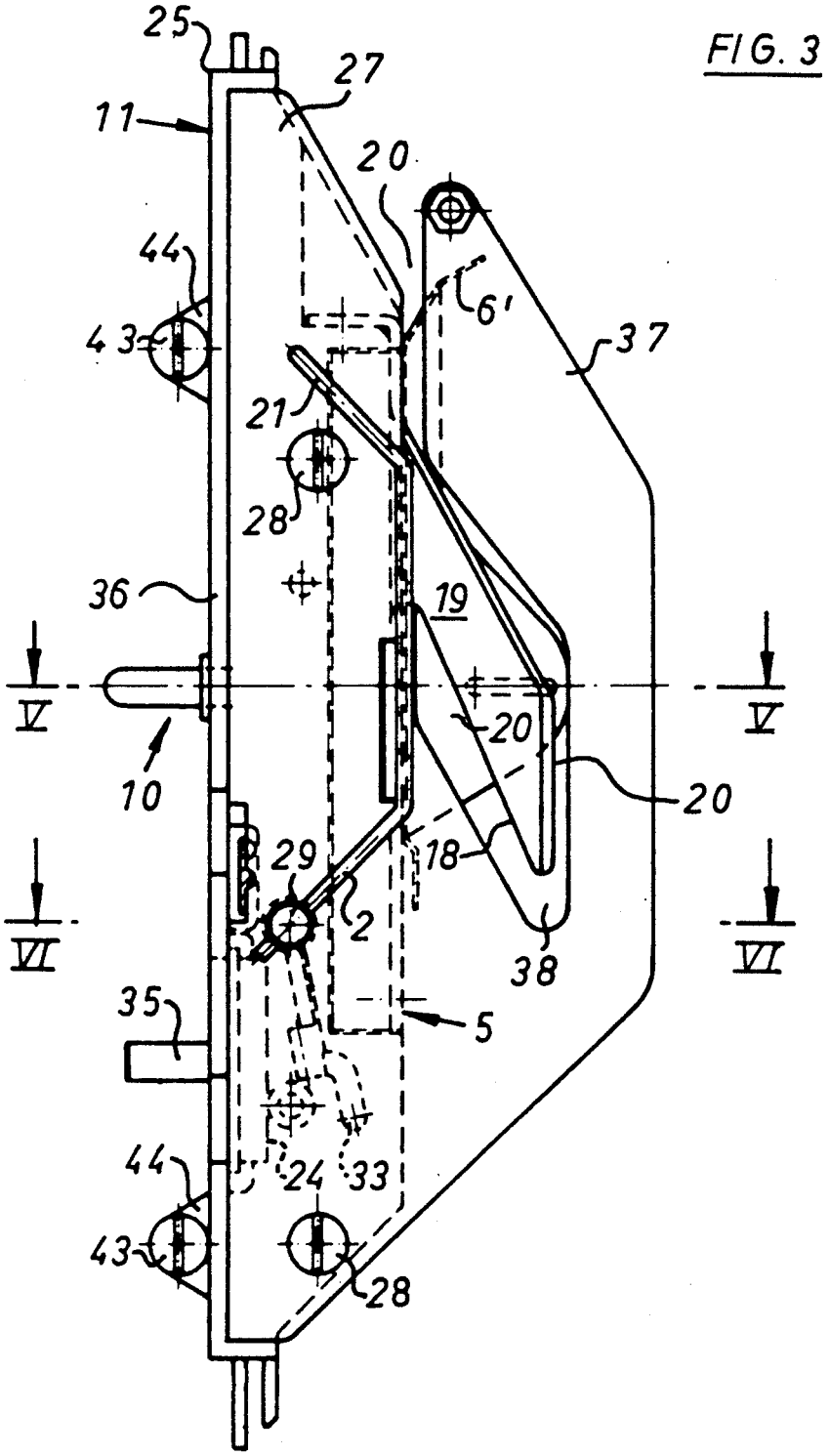
FIG. 3 shows a complete side view of the device of FIG. 1 on the side having the stop motion sensor.
Figure 6:
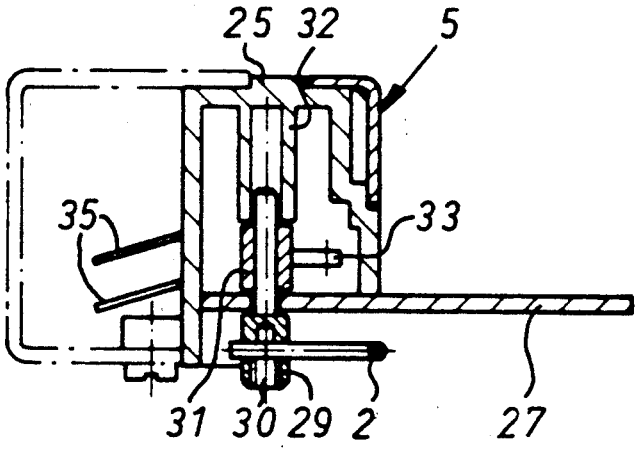
FIG. 6 shows a supplemented section VI—VI of FIG. 3.

The lower, angled end of the stop-motion feeler or sensor rod 2 is set into a hole of the axle pin 29 and is fastened thereto with a stud screw (not shown). This screw is activated by means of an interior multi-edged recess 30, as can be seen from FIG. 6. In its position as shown in FIG. 3, in which it is held by the yarn 4 under tension, its central needle section, which is used to deflect the yarn, runs approximately parallel to the front surface 11' of the clamp housing 11. The upper end 21 of the stop-motion sensor 2, which as a whole is disposed approximately parallel to the metal plate, is bent back in the direction towards the bottom 36 of the body 25. Its slope with the yarn-guiding section of the sensor rod 2 is equal but opposite to the slope of the lower end of the sensor rod 2.

The thrust block 5 is a sheet metal part with an essentially L-shaped cross-section. It is built into an appropriately shaped recess of the housing body 25 and lies flush with its outer surfaces. It is fastened according to FIG. 4 by means of fastening screws 39. The thrust block 5 has a thrust block surface 9 that faces the yarn 4.

Furthermore, the thrust block 5 has a hole, through which passes a bolt, or actuating pin, 10, and, moreover essentially without radial play and vertical or perpendicular to the thrust block surface 9.

The clamping jaw 6 is a sheet metal part which is fastened or secured to the bolt 10. For this fastening, the clamping jaw 6 has activation tabs 13, which protrude at the rear. These activation tabs are mutually parallel, are situated at the same height, and have equally long or coequal slots 14. The ends of a cotter pin 15 of the bolt end 12 engage these slots in such a fashion, and the bolt 10 is axially movable to such an extent, that the clamping jaw 6 can be raised from the thrust block surface 9, when an appropriately large axial force acts on the bolt 10. Incidentally, the clamping jaw 6 of FIGS. 1, 5 has an approximately U-shaped cross-section and is angled at its upper end 6' so as to facilitate insertion of the yarn.

Figure 5:
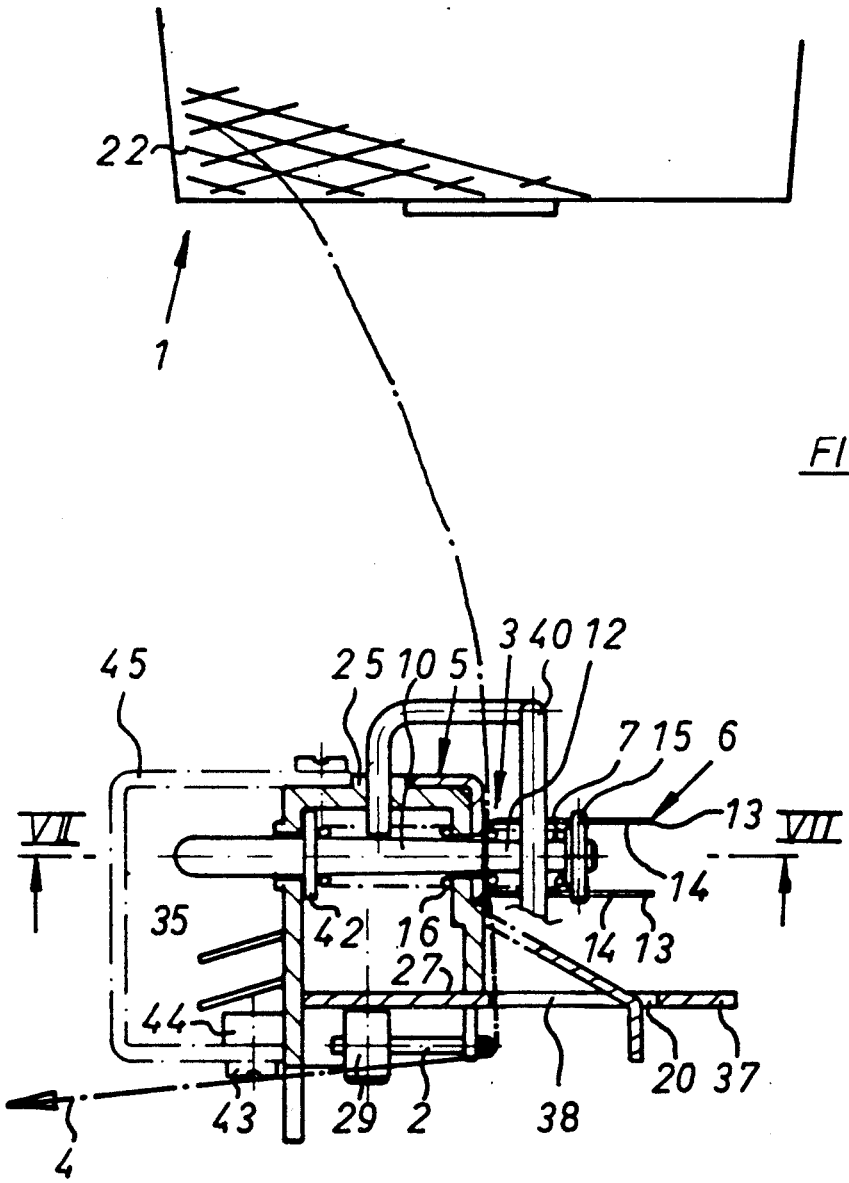
FIG. 5 shows a supplemented section V—V of FIG. 3.

The bolt 10 is assembled with the clamping jaw 6 in such a fashion that the cotter pin 15 does not press directly on the clamping jaw 6. Rather, the latter is retained by the spring force at the thrust block 5. This spring force is created by a control spring 7. A clamping spring 16 is disposed in the interior of the clamping housing 11, so as to surround the bolt 10. It is supported on the one hand at this clamping housing 11 and, on the other, at another cotter pin 42 of the bolt 10, by means of which the bolt 10, which is pushed to the left in FIG. 5, is held at the housing 11. The clamping spring 16 is stronger than the control spring 7, which surrounds the bolt 10 between its cotter pin 15 and the clamping jaw 6. The control spring 7 acts counter to the clamping spring 16 and cannot affect the position of the bolt 10. However, it causes the clamping jaw 6 to make contact with the thrust block surface 9 with a force determined by it. This force can be metered out precisely by displacing the bolt 10. Consequently, it is also possible to adjust precisely the force, with which the clamping jaw 6 presses against the yarn 4 when the bolt 10 is displaced.

When the bolt 10 is not displaced, according to FIG. 5, there is some axial backlash or play between the clamping jaw 6 and the cotter pin 15. This axial backlash or play allows an appropriate displacement of this clamping jaw 6, e.g. when yarning, without thereby needing to displace the bolt 1O.

With thicker yarns, the position of the bolt 10 likewise remains unaffected.

Figure 2:
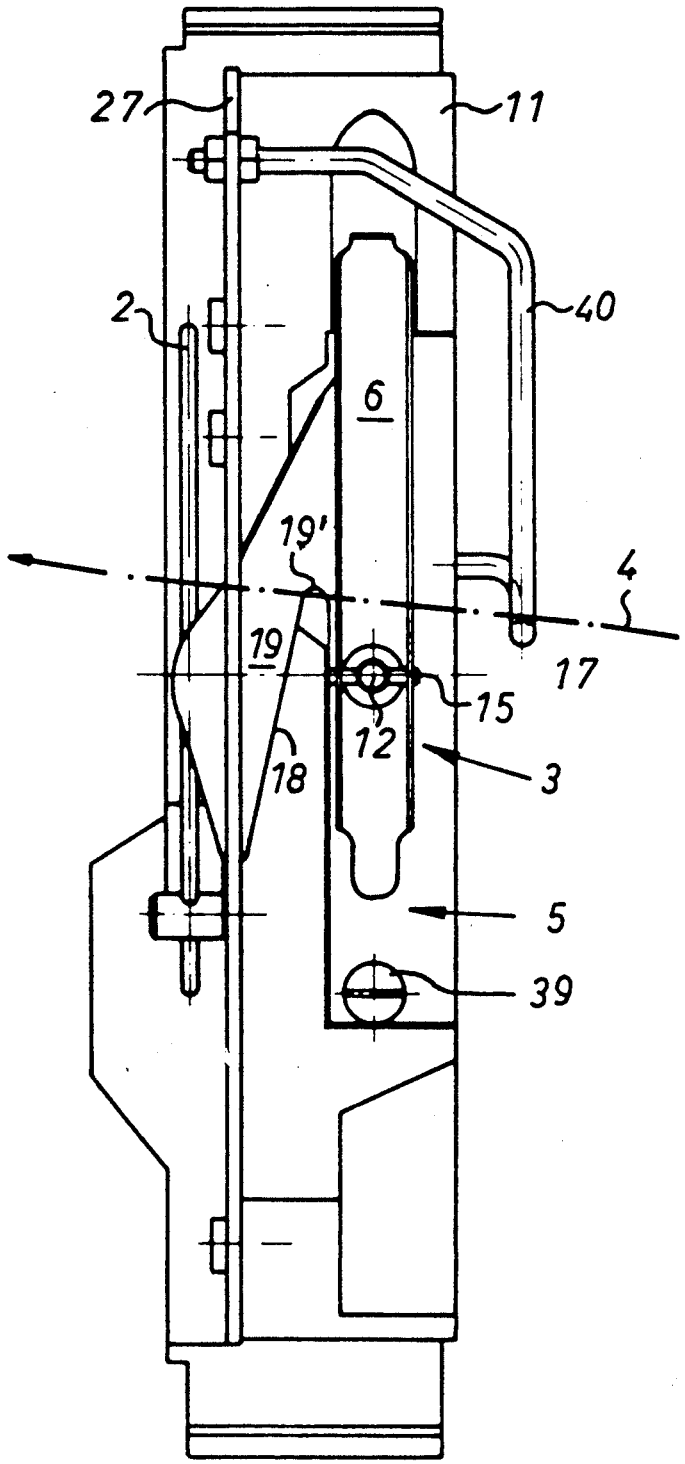
FIG. 2 shows a front view of the device of FIG. 1.

FIGS. 1 through 5 also show that the thrust block 5 has a Z-shaped protrusion 19, which extends into the rhomboidal recess 38 of the cover plate 27. This protrusion 19, on the one hand, has an edge section 19', which upwardly limits the vertical yarn excursions. As a consequence, the yarn 4, in combination with the yarn guiding element 17 of FIG. 2, is secured against height displacements, so that the yarn clamping point is practically immovable in the vertical direction. This contributes towards the constancy of the braking action on the yarn 4. Moreover, the protrusion 19 also has a yarn guiding edge 18, which limits horizontally directed yarn excursions. This does not cut down the horizontal backlash, which is necessary for the yarn 4 due to the motion of the stop-motion sensor 2.

Incidentally, the protrusion 19 is shaped so that, in the region of the recess 38 and together with the cover plate 27, it completes the insert slot 20, so that the yarn 4, on being inserted into the device from the top, is conducted to the yarn line comparatively simply. The hoop 40 above the yarn gripper 3, in combination with the shape of the housing 11, takes care of the horizontal extent of the insertion slot 20. The stop-motion sensor 2, especially at its upper end 21, is designed so that, when the yarn is inserted, it is not acted upon until it reaches the yarn clamping point that is determined by the section 19' of the protrusion 19 and by the yarn guiding element 17. The yarn guiding element 17 ensures that the yarn 4 is held above the bolt 10 so that the latter cannot cause yarn abrasion.

The device and the creel are assembled together through fastening screws 43, which are screwed into the fastening tabs 44 of the housing 11. They thereby fix this housing 11 to a U-shaped vertical frame support 45 of the creel. A displacement device 8, in the form of an adjusting rod, is present in the frame support 45, and all the frame rods can be acted upon in parallel, so that all the yarn grippers can correspondingly be acted on jointly. A control plate 46 for each yarn gripper 3 is fastened at the adjusting device 8. This control plate 46 has a control surface 47. When the adjusting device on the rod 8 is adjusted in height, the bolt 10 can be correspondingly moved horizontally with this control surface 47. As a consequence, the clamping spring 16 is compressed and the control spring 7 is relieved.

FIG. 7*a* shows the gripping position of the yarn gripper 3. In this position, the clamping jaw 6, under the action of the springs 7, 16, presses on the yarn 4 and holds this under tension, so that it cannot slide through further. FIG. 7*b* shows an excursion of the bolt 10, for which the clamping spring 16 is partially compressed and the spring 7 is relieved, corresponding to the displacement of the bolt 10. The bolt 10 reaches such a position by means of the control with the adjusting device 8 while the winding machine—which draws off all the yarns 4—is starting up. This already happens during the first running meter of the warp. FIG. 7*b* shows the state of the yarn brake 3 shortly before the clamping jaw 6 is raised from the thrust block 5. The yarn 4 is monitored from the moment that it is put under tension, on the basis of which the response threshold of the yarn monitor is reached. FIG. 7*c* shows the clamping jaw 6 raised from the thrust block 5. The displacement is achieved by the cotter pin 15 making contact with the activation tabs 13.

I claim:

1. A device for the start-up of bobbin creels for warp beams or warping reels having winding heads, each of which has associated with it a yarn monitor, which yarn monitor causes yarn passing through the device to be deflected by a stop-motion sensor and a yarn gripper by means of which the yarn can be clamped between a longitudinally extended thrust block and a longitudinally extended clamping jaw having limited motion, and which is acted upon by a control element in the form of a control spring the clamping force of which spring in the clamping region between the clamping position and the open position can be differentially controlled while the machine is starting up by an adjusting device which acts jointly on all the yarn grippers wherein the clamping jaw is designed so as to be substantially free of any component of movement in the direction of the longitudinal extent of the thrust block and wherein the clamping force of the clamping jaw is directed exclusively perpendicular to the thrust block surface, the clamping jaw acted upon by the control spring is held by a movable clamp actuating pin which is disposed perpendicular to the thrust block surface and the path of the yarn between the thrust block and the clamping jaw, and wherein the clamp actuating pin is mounted so as to be axially movable in a clamp housing which incorporates the thrust block surface and passes through the movable clamping jaw so as to be radially without backlash, and wherein the end of the actuating pin at the rear of the jaw engages the clamping jaw with limited axial backlash and the clamping jaw on its backside has protruding activation tabs with slots incorporated therein parallel to the actuating pin and receiving therein the outer portions of a cotter pin extending through the end of the actuating pin.

2. A yarn guide and monitoring mechanism for clamping and controlling the tension of yarn passing from bobbin creels to warp beams or warping reels arranged for handling a plurality of yarns at one time comprising:

(a) a support housing, (b) a longitudinally extended thrust block means mounted upon the support housing, (c) a longitudinally extending clamping jaw having a planar yarn clamping surface disposed parallel to a clamping surface of the thrust block, (d) said clamping jaw being mounted upon a movable clamp actuating means activated by a movable activating means, in such manner that the movement of the clamping jaw exactly duplicates the movement of the clamp actuating means, (e) the movable clamp actuating means having a range of movement perpendicular to the yarn clamping surfaces of both the thrust block and the clamping jaw such that movement of the clamping surface of the clamping jaw toward the clamping surface of the thrust block is always exactly perpendicular to the two clamping surfaces with no component of motion parallel to such surfaces, whereby damage to the yarn from nonperpendicular components of motion are prevented, (f) spring means for biasing the clamping jaw carried upon the movable clamp activating means toward the thrust block, (g) engagement means in the end of the outer portion of the pin means adapted to slidably engage with slot means in the clamping jaw, and wherein the movable clamp actuating means is biased in a direction to carry the clamping jaw away from the thrust block by cam means on said movable adjusting device, the clamp actuating means being in the form of a pin means and the spring means is in the form of two separate springs disposed about the pin means one above the other, the first of which springs is stronger than the second, the first spring tending to bias the movable clamp actuating means to move the clamping jaw toward the thrust block and the second of which springs biases the clamping jaw toward the thrust block with respect to the outer end of the pin means, whereby when the pin means is urged outwardly by cam means on the movable adjusting means, the engagement means slides upwardly in the slot means relieving compression in the second spring means to decrease pressure between the clamping jaw and the thrust block and when the pin means is biased inwardly by the first spring, the second spring means biases the clamping jaw progressively toward the thrust block with increasing force.

3. A yarn guide and monitoring mechanism for adjustably clamping and controlling the tension of yarn passing from bobbin creels to warp beams or warping reels arranged for handling a plurality of yarns at one time comprising:

(a) a support housing, (b) a thrust block means mounted upon the support housing and incorporating a planar yarn clamping surface, (c) a clamping jaw having a planar yarn clamping surface opposed to the yarn clamping surface of the thrust block, (d) the clamping jaw being mounted upon a movable support means arranged and constructed to move the clamping jaw toward or away from the thrust block, (e) activation and control means to urge the movable support means away from the thrust block, (f) a first resilient means positioned to urge the movable support means oppositely to the movement engendered by the activation and control means, (g) a second resilient means to urge the clamping jaw toward the thrust block, (h) the first resilient means potentially developing a substantially greater force when flexed than the second resilient means when flexed, (i) the movable support means being movably secured to the clamping jaw with a predetermined range of allowable mechanical play such that at the outer range of such play the clamping surface of the clamping jaw will be held against the clamping surface of the thrust block with a predetermined minimum force engendered by a minimum flexion of the second resilient means and at the inner range of such play the clamping surface of the clamping jaw will be held against the clamping surface of the thrust block with a maximum force engendered by the maximum resilient flexion of the second resilient means, (j) the movable support means having a range of movement under the influence of the activation and control means whereby at its maximum movement in a direction that tends to bring the clamping jaw toward the thrust block the first resilient means has a minimum flexion, while at its maximum movement in a direction which tends to relieve the clamping jaw from the thrust block, the first resilient means has a maximum flexion, (k) guide means to guide the yarn between the clamping surfaces of the thrust block and clamping jaw substantially parallel to such surfaces, (l) the movable support means comprising a pin means and the first and second resilient means comprising coil spring means surrounding said pin means, (m) the clamping jaw being movably secured to the pin means by a cross pin means passing through the pin means, the ends of which cross pin means are received in elongated retaining groove means upon the clamping jaw structure oriented substantially parallel to the longitudinal orientation of the pin means, and wherein the retaining groove means upon the clamping jaw structure comprises elongated slots within the clamping jaw structure and the elongated slots are positioned in tabs extending parallel to each other away from the clamping surface of the clamping jaws.

* * * * *